United States Patent [19]

Fuller et al.

[11] 3,962,487

[45] June 8, 1976

[54] METHOD OF MAKING CERAMIC SEMICONDUCTOR ELEMENTS WITH OHMIC CONTACT SURFACES

[75] Inventors: Peter G. Fuller, Lakeville, Mass.; Hans A. Stoeckler, Woonsocket, R.I.

[73] Assignee: Texas Instruments Incorporated, Dallas, Tex.

[22] Filed: Feb. 3, 1975

[21] Appl. No.: 546,491

[52] U.S. Cl. ..... 427/82; 252/512; 252/518; 252/521; 427/88; 427/123; 427/126; 427/372; 427/403; 427/419

[51] Int. Cl.[2] ..... B05D 5/12

[58] Field of Search ..... 427/82, 126, 88, 123, 427/372, 403, 419; 252/512, 518, 519, 521

[56] References Cited

UNITED STATES PATENTS 3,248,251 4/1966 Allen ..... 427/380

*Primary Examiner*—Cameron K. Weiffenbach

*Attorney, Agent, or Firm*—John A. Haug; James P. McAndrews; Russell E. Baumann

[57] ABSTRACT

Ceramic semiconductor elements having ohmic contact surfaces are made by dispersing bentonite clay in a bonding composition consisting of a metal powder in a phosphate-chromate-metal ion solution to form a thixotropic coating material, by screen printing the coating material onto limited surface areas of ceramic semiconductor bodies, and by heating the coated bodies for curing the coating material to form adherent ohmic contact layers on the limited surface areas of the ceramic bodies.

6 Claims, No Drawings

METHOD OF MAKING CERAMIC SEMICONDUCTOR ELEMENTS WITH OHMIC CONTACT SURFACES

Ceramic semiconductor materials such as doped barium titanates and the like are commonly pressed and sintered into the form of thin, flat, disc-like ceramic bodies and are provided with ohmic contacts on the flat surfaces of the bodies to form ceramic semiconductor elements. The ceramic materials display very advantageous resistance-temperature properties and the elements therefore find use as self-regulating electrical resistance heaters and as current-regulating resistors in a wide variety of high volume applications. For most of these applications, only very small semiconductor elements are required and the ceramic bodies used in the elements, typically about 0.750 inches in diameter and about 0.100 inches thick, are adapted to be mass produced with uniform resistance-temperature properties at very low cost. However, considerable difficulty has been encountered in economically forming reliable ohmic contacts on the small ceramic bodies.

For example, in one procedure for forming ohmic contacts on the ceramic bodies, the flat disc surfaces of the bodies have been flame sprayed with metal as shown in U.S. Pat. No. 3,676,211 to Kourtesis et al. While ohmic contacts formed in this manner have been solderable and have had excellent electrical properties, it would be desirable to provide the ceramic bodies with ohmic contacts which are more strongly adherent than the contacts obtained by flame spraying. On the other hand, strongly adherent ohmic contact layers have been formed on such ceramic bodies using bonding compositions such as those shown in U.S. Pat. No. 3,248,251 to Allen. Here, however, considerable difficulty has been experienced in applying the bonding composition to selected limited surface areas of the small ceramic bodies without adding an excessively large increment to the cost of the finished semiconductor elements.

It is an object of this invention to provide novel and improved ceramic semiconductor elements; to provide such elements having ohmic contact layers on selected limited surfaces of ceramic bodies incorporated in the elements where the ohmic contact layers are strongly adherent to the ceramic bodies, where the contact layers are readily solderable, and where the contact layers display good electrical properties; to provide novel and improved methods for forming ohmic contact layers on selected limited surface areas of small ceramic bodies; to provide novel and improved coating materials for use in forming such contact layers; and to provide such coating materials and methods for forming such ohmic contact layers in a reliable and economical manner.

Other objects, advantages and details of the coating materials, methods and ceramic semiconductor elements of this invention appear in the following detailed description of preferred embodiments of the invention.

In accordance with this invention, thin, flat disc-like ceramic bodies or substrates are formed in any conventional manner using any of the commonly known ceramic semiconductor materials including those materials which display either positive temperature coefficients of resistivity or materials which display negative temperature coefficients of resistivity. That is, ceramic bodies are formed of various titanates, stannates and zirconates of barium, strontium or lead or the like and, where desired, incorporate rare earth and other dopants such as lanthanum, praesodymium or yttrium or the like as well as various modifiers such as manganese and silicon. These materials are pressed together with a binder and are fired in any conventional way. As such ceramic semiconductor materials are well known, they are not further described herein and it will be understood that any of the known ceramic semiconductor materials are used in the semiconductor elements of this invention and that such materials are pressed and fired in any conventional way to form disc-like ceramic bodies within the scope of this invention. Typically, for example, a lanthanum doped barium titanate material having the general formula $Ba_{.997}Y_{.004}TiO3_{1.01}$ is pressed and fired to form a flat ceramic body having a diameter of about 0.750 inches and a thickness of about 0.100 inches.

In accordance with this invention, a coating material is then prepared for use in forming ohmic contact layers on selected limited surface areas of the ceramic bodies above described, the coating material incorporating a bonding composition such as that described in U.S. Pat. No. 3,248,251 to Allen. That is, the coating material of this invention incorporates a bonding composition consisting of a solid particulate material having a gain size of less than 325 mesh, at least a portion of which comprises a metal powder such as aluminum, this solid particulate material being dispersed in an aqueous solution containing substantial amounts of phosphate ion, anion selected from the group consisting of chromate, molybdate and mixtures thereof, and metal cation. As this bonding composition is well known and is fully described in the above-noted patent to Allen, the bonding composition is not further described herein and it will be understood that any reference herein to a bonding composition consisting essentially of a dispersion of a solid particulate material in an aqueous phosphate-chromate-metal ion solution shall mean any of the bonding compositions shown in the patent to Allen where at least part of the solid particulate material shall comprise a metal powder.

In accordance with this invention, the bonding composition consisting essentially of a dispersion of a solid particulate material in an aqueous phosphate-chromate-metal ion solution as above described is combined with a selected quantity of any of the various clay materials having the characteristics of bentonite clay to form a coating material having selected thixotropic properties. These clay materials include the materials commonly known as bentonite clay, montmorillonite, kaolin, kaolinite and fuller's earth and are characterized essentially by the presence of platelets of various hydrated silicates of aluminum, magnesium and calcium, have specific gravities on the order of about 2.6, and have average particle diameters of about 0.002 inches and maximum particle diameters of about 0.005 inches. As any of these various clay materials are used in the coating material of this invention it will be understood that, where reference is made herein to bentonite clay, that term shall include any of the clay materials or any mixture of the clay materials above-described.

In accordance with this invention, sufficient bentonite clay is combined with the bonding composition consisting essentially of a dispersion of a solid particulate material in an aqueous, phosphate-chromate-metal ion solution to constitute from about 3 to 18 percent by weight of the resulting coating material and to form a coating material having a pH in the range from about 2.7 to 2.9. Preferably the bentonite clay is dispersed in the noted bonding composition by slowly adding the clay to the bonding composition while vigorously mixing the bonding composition as with a Waring blender or the like. After the desired quantity of clay is added to the noted bonding composition, the coating material is blended or mixed for an additional 10 to 15 minutes and is then readily stored in polyethylene bottles or the like. In this way, a coating material of desired thixotropic properties is achieved. Thus, where the bentonite clay addition made to the noted bonding composition constituted from 3 to 18 percent by weight of the resulting coating material, and where the viscosity of the coating material was measured using a Model LTV Brookfield Viscometer, the rheological properties of the coating material were as shown in Table I.

Table I

| Weight Percent Bentonite Clay | Viscosity at 25°C. (Centipoise) at 1.5 RPM | Viscosity at 25°C. (Centipoise) at 12 RPM |
|---|---|---|
| 8.0 | $6.4 \times 10^4$ | $2.4 \times 10^4$ |
| 9.0 | $6.0 \times 10^4$ | $2.75 \times 10^4$ |
| 10.0 | $7.2 \times 10^4$ | $3.2 \times 10^4$ |
| 12.2 | $1.32 \times 10^5$ | $3.85 \times 10^4$ |
| 15.0 | $4.0 \times 10^5$ | $5.0 \times 10^4$ |

In accordance with this invention, the coating material of this invention is screen printed onto selected limited portions of the flat disc surfaces of the above-noted ceramic bodies wherever ohmic contact layers are intended to be formed on the bodies. Using the coating material of this invention, any conventional screen printing apparatus is employed in depositing the coating material in very well-defined areas of the ceramic body surfaces with little or no difficulty. Printing of even very small areas is easily accomplished and printing of several areas on the same flat surface of a ceramic body causes no difficulty. Printing of the coating material on opposite sides of the ceramic bodies is also easily accomplished without requiring any specific drying step between the printing of the opposite body sides. Typically, for example, the screen printing is performed using a Model 330 Screen Printer made by AMI/Presco of Somerville, New Jersey using a 180 mesh silk screen but any other conventional screen printing apparatus is also used. In this regard, it is noted that where the coating material embodies about 8 percent by weight of bentonite clay, the coating material flows very readily during the screen printing and easily covers the intended surface areas of the ceramic body. Where about 9–14 percent by weight of bentonite clay is used better print definition is achieved and thicker print deposits were more easily made where desired. The coating material also tended to dry more quickly in the ceramic body but also tended to dry more quickly on the printer screen. These trends generally continue where higher weight percentages of bentonite are used, a coating material of about 9 weight percent bentonite clay appearing to have optimum properties for ease in printing while achieving good print definition, thickness control and speed in drying on the ceramic body. Where 15 percent or more by weight of bentonite clay is used, the coating material tends to become somewhat thicker than desired for complete ease in printing but provides good coverage of the desired ceramic surface areas even though some undesirable pin-holing of the coated areas tends to occur.

In accordance with this invention, the ceramic bodies screen printed with the coating material of this invention as above-described are then fired in air at a temperature in the range from about 625° to 680°C. for about 10 to 20 minutes. Preferably for example, the coated ceramic bodies are fired in air in a moving furnace for about 15 minutes at a temperature of about 645°C. In this way, the coating material screen printed on the ceramic bodies is heat-cured and is securely bonded to the ceramic bodies to form excellent ohmic contact layers on the screen printed surfaces of the bodies. The ohmic contact layers are strongly adherent to the bodies and display no tendency to flake off the bodies. The ohmic contact layers also display excellent electrical properties. In this regard, it is observed that the solid particulate materials such as metal powder incorporated in the bonding composition used in the coating materials tend to retain their discrete nature but is believed that these particulate materials as well as the bentonite clay additive to the bonding composition participate in chemical reactions with the other constituents of the coating materials in forming the noted ohmic contact layers. Typically, the ohmic contact layers have a thickness of about 0.001 inches.

In accordance with this invention, the ohmic contact layers formed on the ceramic semiconductor bodies as above-described are preferably further coated with any of the various conventional screen-printable metal contact materials known in the electronic arts for improving the solderability of the ohmic contact layers. That is, where strongly adherent ohmic contact layers are formed on the ohmic semiconductor bodies according to this invention, the solderability of the surfaces of these ohmic contact layers is adapted to be improved in any conventional manner. These additional coatings include any of the various metal-containing glass frits in organic solvents or the like which are conventionally adapted or screen printing and for fusing after printing to form metal layers on a body. Typically for example, the ohmic contact layers provided by this invention are additionally provided with a silver coating by screen printing a metal containing glass frit sold under the designation Coating 7713 by Dupont Chemical Company. It should be noted that, in accordance with this invention such additional coatings can be screen printed onto the coating materials of this invention either before or after the coating materials of this invention have been fired as above-described. Where applied before the coating material of this invention is cured, the additional coating material is fused during curing of the coating material of this invention. Where the additional coating is applied after curing of the coating material of this invention, the additional coating is then fired at a temperature of about 600°C. for about 15 minutes. Alternately, additional metal coatings are formed on the ohmic contact layers by flame spraying. Usually where such additional coatings are used, the additional coatings are dired by heating at a temperature to about 120°C. for about 10 minutes immediately after application to facilitate subsequent handling of the coated ceramic bodies.

In this way, novel and improved ceramic semiconductor elements having ohmic contacts thereon are provided by this invention. For example, where a disc-like ceramic body of yttrium-doped barium strontium titanate having an 80°C. Curie temperature is screen printed on selected limited areas of the flat disc surfaces of the body using the coating material of this invention embodying 9 percent bentonite clay by weight, where Dupont 7713 silver coating was applied over this coating material as above-described, and where the coated body was subsequently fired in air at 630°C. for 15 minutes to form ohmic contact layers on the body, the ohmic contact layers were found to be readily solderable and strongly adherent and displayed a resistivity of about 74.7 plus or minus 4.0 ohm-centimeters at 25°C. at minimum voltage level and a resistivity of 44.5 plus or minus 1.4 ohm-centimeters at 25°C. at 170 volts d.c. Similarly, where similar ohmic contact layers were formed on a yttrium-doped barium titanate ceramic body having a Curie temperature of 120°C., the ohmic contact layers were again easily soldered, were again strongly adherent, and displayed a resistivity at minimum voltage level at 25°C. of about 35.2 plus or minus 4.7 ohm-centimeters.

It should be understood that although preferred embodiments of this invention have been described herein by way of illustration, this invention includes all modifications and equivalents of the disclosed embodiments falling within the scope of the appended claims.

We claim:

1. A method for forming a ceramic semiconductor element having ohmic contact surfaces thereon comprising the steps of combining bentonite clay with a bonding composition consisting essentially of a dispersion of a solid particulate material in an aqueous phosphate-chromate-metal ion solution to form a thixotropic coating material, screen-printing the coating material on selected limited surfaces of a ceramic semiconductor body, and heating said coated ceramic semiconductor body for heat curing said coating material to form ohmic contact layers in adherent relation to said ceramic semiconductor body.

2. A method as set forth in claim 1 wherein said coating material incorporates from about 3 to 18 percent by weight of bentonite clay.

3. A method as set forth in claim 2 wherein said coated ceramic semiconductor body is heated to a temperature from about 625° to 680°C. for a period from about 10 to 20 minutes.

4. A method as set forth in claim 3 wherein an additional metal coating is formed on said ohmic contact layers for improving the solderability thereof.

5. A method as set forth in claim 4 wherein a metal-containing glass frit is deposited over the coating material screen-printed onto the ceramic body before said heat curing of said coating material and wherein said glass frit is fused during said heat-curing of said coating material for improving solderability of said ohmic contact layers.

6. A method as set forth in claim 4 wherein a metal containing glass frit is deposited over said ohmic contact layers and is subsequently heated for fusing said glass frit to improve the solderability of said ohmic contact layers.

* * * * *